US007554515B2

(12) United States Patent
Son et al.

(10) Patent No.: US 7,554,515 B2
(45) Date of Patent: Jun. 30, 2009

(54) METHOD OF DRIVING LIQUID CRYSTAL DISPLAY

(75) Inventors: Hyeon Ho Son, Kyunggi-do (KR); Jong Jin Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 154 days.

(21) Appl. No.: 09/893,676

(22) Filed: Jun. 29, 2001

(65) Prior Publication Data

US 2002/0080100 A1 Jun. 27, 2002

(30) Foreign Application Priority Data

Dec. 22, 2000 (KR) ..... 10-2000-79988

(51) Int. Cl.
*G09G 3/36* (2006.01)

(52) U.S. Cl. ..... 345/87; 345/94; 345/102

(58) Field of Classification Search ..... 345/55–57, 345/87–89, 90, 92, 94, 99, 204, 95, 102, 345/58, 100, 50

See application file for complete search history.

(56) References Cited

U.S. PATENT DOCUMENTS 5,666,133 A * 9/1997 Matsuo et al. ..... 345/100
6,504,523 B1 * 1/2003 Sugawara et al. ..... 345/98
6,552,704 B1 * 4/2003 Zavracky et al. ..... 345/88

FOREIGN PATENT DOCUMENTS

JP 3-212615 9/1991

OTHER PUBLICATIONS

Hasegawa et al. Pub. No. US 2001/0011979.*

* cited by examiner

*Primary Examiner*—Regina Liang
*Assistant Examiner*—Jennifer T Nguyen
(74) *Attorney, Agent, or Firm*—Morgan, Lewis & Bockius LLP

(57) ABSTRACT

A method of driving a liquid crystal display device during one display frame includes the steps of applying one of a high-level common voltage and a low-level common voltage to a plurality of liquid crystal cells of the liquid crystal display device to write data into the liquid crystal cells within a time interval shorter than one display frame interval, and turning on a backlight after said data writing to display an image.

16 Claims, 5 Drawing Sheets

METHOD OF DRIVING LIQUID CRYSTAL DISPLAY

The present invention claims the benefit of Korean Patent Application No. P2000-79988 filed on Dec. 22, 2000 in Korea, which is hereby incorporated by reference.

BACKGROUND OF THE INVENTION

1. Field of the Invention

The present invention relates to a technique for driving a liquid crystal display, and more particularly to a method of driving a liquid crystal display that is capable of preventing a generation of a residual image and a flicker phenomenon to improve a picture quality.

2. Description of the Related Art

Generally, a liquid crystal display (LCD) of an active matrix driving system uses thin film transistors (TFT's) as switching devices to display a natural moving picture. Since such a LCD can be implemented into a device smaller in size than the presently existing Brown tube, it has been widely used as a monitor for personal and notebook computers as well as office automation equipment such as copy machines and portable equipment such as cellular phones and pagers.

In FIG. 1, a conventional LCD allows a liquid crystal display device to record image data on the liquid crystal cells during a display frame of 16.67 ms, thereby displaying an image, and continuously records image data in each display frame. In such a LCD device, a backlight is always turned on. In the course of recording the data in any one display frame, a liquid crystal display device also is responsive to a data voltage applied to a liquid crystal cell in the previous display frame. Accordingly, in the conventional LCD, a residual image of the previous display frame remains on the liquid crystal display screen. In other words, since a response time of the liquid crystal display exists when the current display frame is turned over into the next display frame, data of the previous display frame remains on the display screen as shown in FIG. 2, thereby deteriorating picture quality. This phenomenon presents a more serious problem in the case of a moving image.

To overcome this problem, a LCD that allows an image signal to be compensated at every display frame has been disclosed in Japanese Laid-open Patent Gazette No. 1991-212615. In this LCD device, a modified difference signal is calculated on a basis of a difference signal between fields for each display frame. Specifically, a modified difference signal is determined based on a difference signal between adjacent scanning lines and a level of an image signal. Then the modified difference signal is added to the image signal to eliminate a residual display image that would otherwise emerge upon the liquid crystal display screen.

However, since such a LCD device uses a difference signal between fields to construct a single image, i.e., a difference signal between adjacent scanning lines, the difference signal may distort the image signal. Accordingly, a distorted image may result that is different from an initial image on the liquid crystal display screen. Furthermore, in the conventional LCD, a voltage difference ΔVp is generated between a voltage Vpxl that is applied to the liquid crystal cell and an effective voltage Veff that remains in the liquid crystal cell, thereby causing a flicker phenomenon.

In FIG. 3, a pixel unit of the conventional LCD device includes a gate electrode G electrically connected to a gate line 2, a drain electrode D electrically connected to a data line 4, and a thin film transistor (TFT) 6 electrically connected to a pixel electrode PXL. The pixel unit further includes a liquid crystal cell 8 and a storage capacitor Cst disposed between the pixel electrode PXL and a common electrode Vcom.

The TFT 6 is selectively turned on by a pulse-shaped gate high voltage, as shown in FIG. 4, and electrically connects the data line 4 to the liquid crystal cell 8 and the storage capacitor Cst. The liquid crystal cell 8 and the storage capacitor Cst are charged with a data voltage $V_D$ from the data line 4 when the TFT 6 is turned on, and maintains the same voltage until the TFT 6 is again turned on (i.e., when a high voltage Vgh is applied to the gate electrode). When a voltage on the gate electrode is changed from a high voltage Vgh to a low voltage Vgl (i.e., when the TFT 6 is turned off) a voltage $V_{LC}$ at the liquid crystal cell decreases by ΔVp.

A voltage difference ΔVp between an effective voltage Veff remaining in the liquid crystal cell and a voltage Vpxl that is applied to the liquid crystal cell is given by the following equation:

$$\Delta Vp = Cgs(Vgh - Vgl)/Cgs + Cst + Clc \quad (1)$$

wherein Cgs represents a parasitic capacitance between the gate and source electrodes, Cst represents a storage capacitor value, Clc represents a capacitance of the liquid crystal cell, Vgh represents a gate high voltage, and Vgl represents a gate low voltage.

It can be seen from the above equation (1) that ΔVp is mainly dominated by the parasitic capacitance Cgs and a voltage difference (i.e., Vgh−Vgl) of the gate voltage. In a liquid crystal cell having positive and negative data voltages as shown in FIG. 4, an effective voltage Veff that remains within the liquid crystal cell becomes lower than a voltage Vpxl that is applied to the liquid crystal cell by ΔVp. In particular, since the screen has a different brightness as ΔVp becomes different for each liquid crystal cell, a flicker phenomenon occurs. A major reason for this difference in brightness is that a capacitance Clc of the liquid crystal cell becomes different for each liquid crystal cell due to an affect of the previous data when a new data is applied.

SUMMARY OF THE INVENTION

Accordingly, the present invention is directed to a method of driving a liquid crystal display that substantially obviates one or more of the problems due to limitations and disadvantages of the related art.

An object of the present invention is to provide a method of driving a liquid crystal display device to reduce flicker.

Another object of the present invention is to provide a method of driving a liquid crystal display that is capable of preventing generation of a residual image and improving picture quality.

Additional features and advantages of the invention will be set forth in the description which follows, and in part will be apparent from the description, or may be learned by practice of the invention. The objective and other advantages of the invention will be realized and attained by the structure particularly pointed out in the written description and claims hereof as well as the appended drawings.

In order to achieve these and other objects of the invention, a method of driving a liquid crystal display device during one display frame includes the steps of applying one of a high-level common voltage and a low-level common voltage to a plurality of liquid crystal cells of the liquid crystal display device to write data into the liquid crystal cells within a time interval shorter than one display frame interval, and turning on a backlight after said data writing to display an image.

In another aspect of the present invention, a method of driving a liquid crystal display device during one display frame includes the steps of inputting data signals to a plurality of liquid crystal cells, and allowing the liquid crystal cells time to respond to the applied data signals, wherein one of a high-level common voltage and a low-level common voltage is applied to the liquid crystal cells as a reference voltage during the inputting step.

It is to be understood that both the foregoing general description and the following detailed description are exemplary and explanatory and intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1:
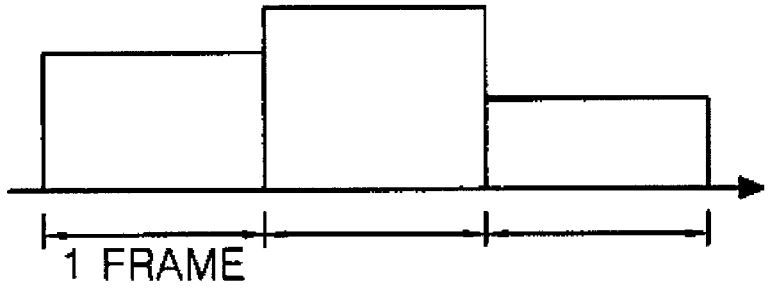
FIG. 1 CONVENTIONAL ART
FIG. 1 shows a conventional method of driving a liquid crystal display.
Figure 2:
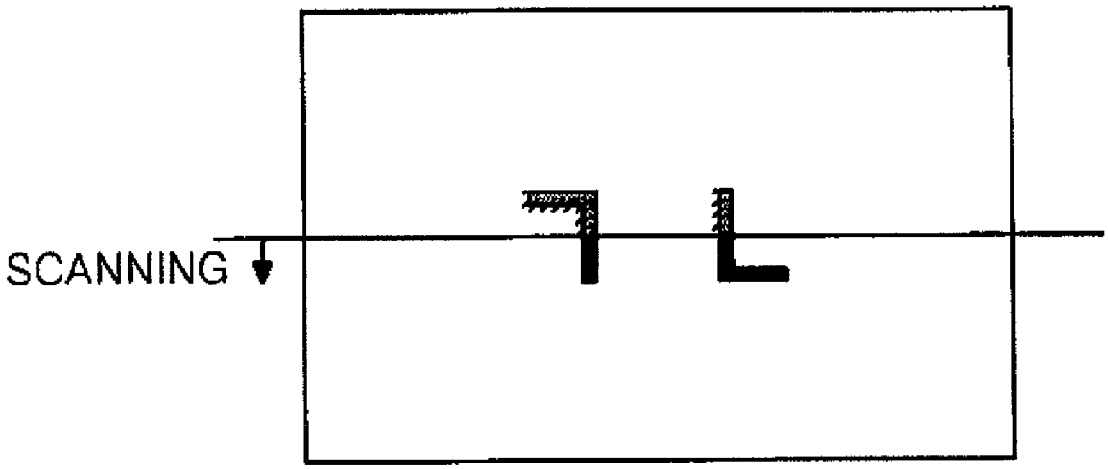
FIG. 2 CONVENTIONAL ART
FIG. 2 shows an instantaneous moving image in the conventional liquid crystal display.
Figure 3:
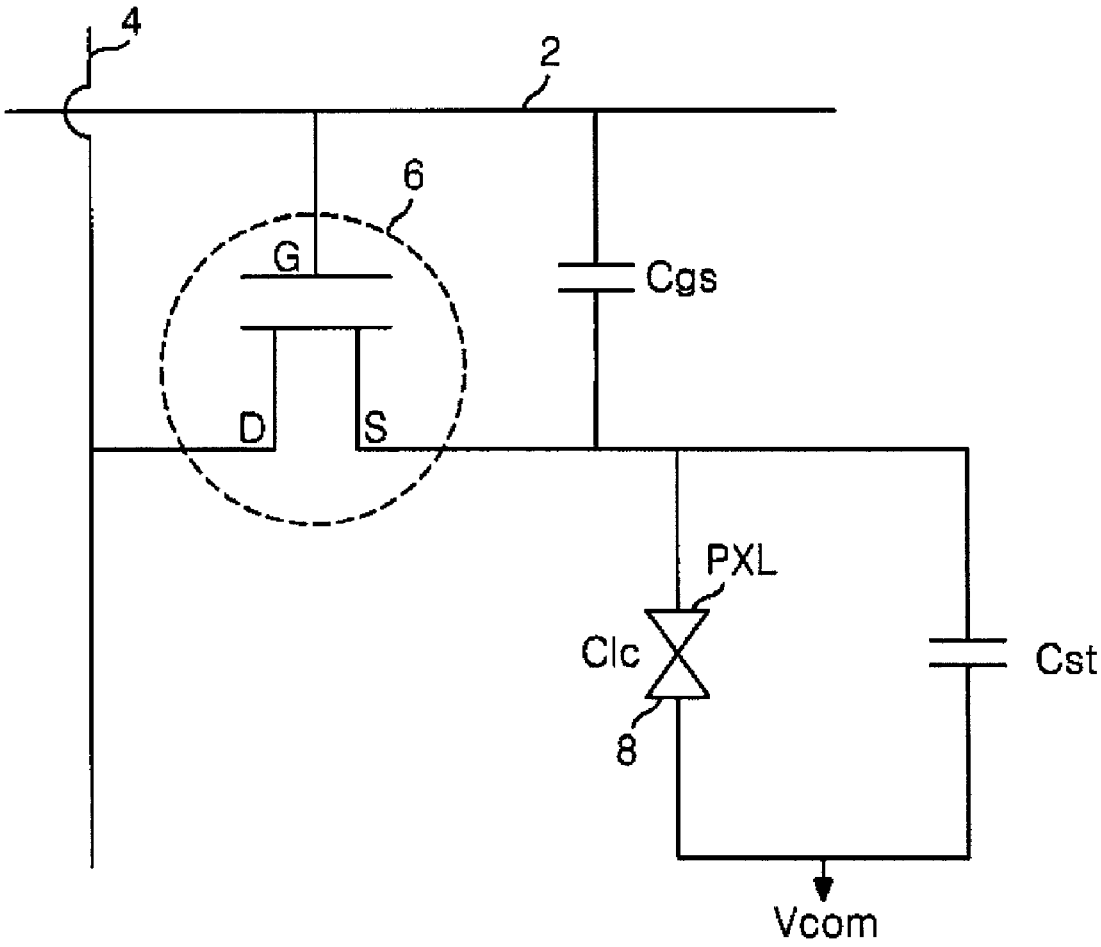
FIG.3 CONVENTIONAL ART
FIG. 3 is an equivalent circuit diagram of each liquid crystal cell in the conventional liquid crystal display.
Figure 4:
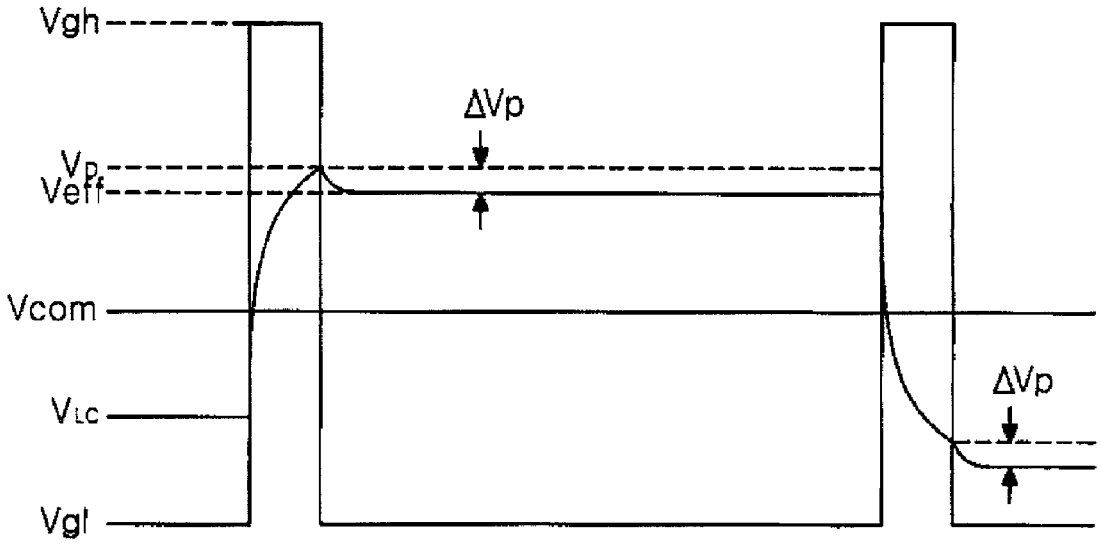
FIG. 4 CONVENTIONAL ART
FIG. 4 is a waveform diagram showing voltages applied to the conventional liquid crystal cell shown in FIG. 3.
Figure 5:
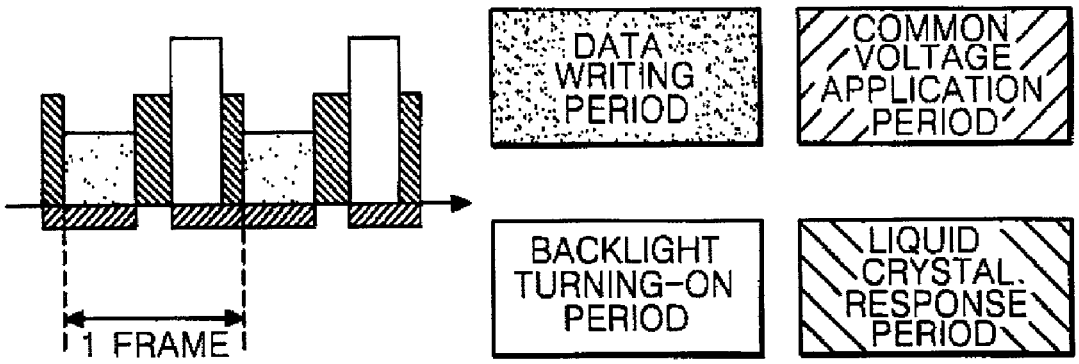
FIG. 5 is a diagram for explaining a method of driving a liquid crystal display according to an embodiment of the present invention.
Figure 6:
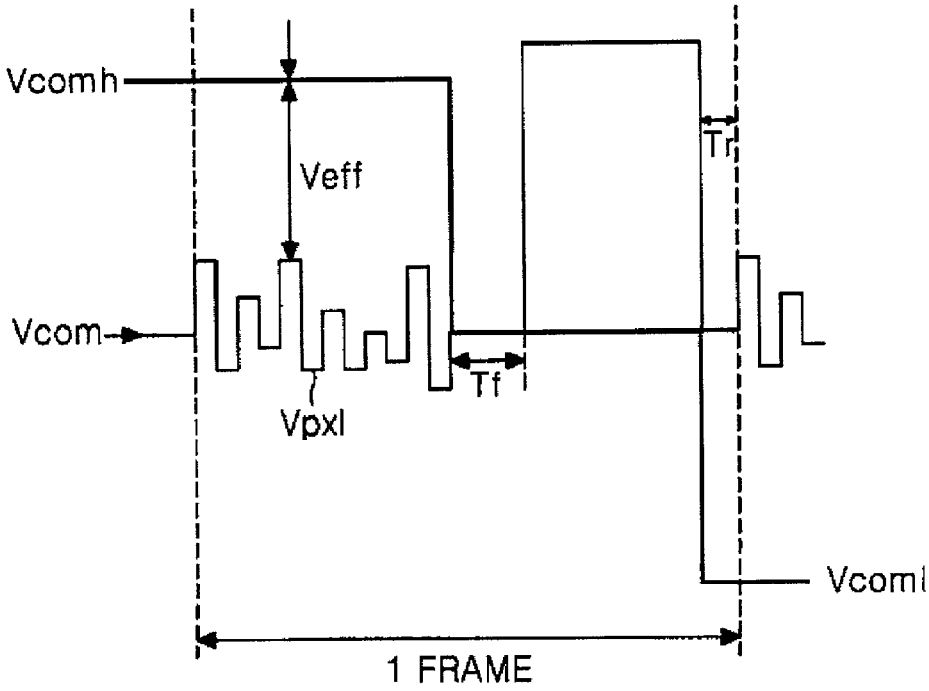
FIG. 6 is a waveform diagram representing a variation in a voltage applied to a liquid crystal cell by the liquid crystal display driving method shown in FIG. 5.

In FIGS. 5 and 6, a display frame is divided into a period at which a data is written into a liquid crystal cell (DATA WRITING PERIOD), a period at which a voltage Vcomh higher or a voltage Vcoml lower than a reference common voltage Vcom is applied to the liquid crystal cell during a response time interval of a liquid crystal when data is being applied to the liquid crystal cell (COMMON VOLTAGE APPLICATION PERIOD), a response period of a liquid crystal after the data is written (LIQUID CRYSTAL RESPONSE PERIOD), and a period at which a backlight is turned on or off (BACKLIGHT TURNING-ON PERIOD), and a period at which a liquid crystal is re-aligned (a second LIQUID CRYSTAL RESPONSE PERIOD), for time divisional driving of the LCD.

In the period at which a data is written into the liquid crystal cell (DATA WRITING PERIOD), one display frame data is recorded into the liquid crystal cell at a shorter time interval than one display frame interval of 16.67 ms. To this end, as shown in FIG. 6, a high-level common voltage Vcomh higher than, or a low-level common voltage Vcoml lower than, a common voltage Vcom typically applied to the conventional LCD is applied to an upper substrate. In general, a gate high voltage Vgh and a gate low voltage Vgl are used as the high-level common voltage Vcomh and the low-level common voltage Vcoml, respectively. For example, when a common voltage is set to 5V, the gate high voltage Vgh may be set to 20V and the gate low voltage Vgl to −5V. Thus, the high-level common voltage Vcomh is set to more than +15V and the low-level common voltage Vcoml is set to less than −5V. Such common voltages Vcomh and Vcoml have values substantially larger than or substantially lower than a data voltage Vpxl that is applied to the liquid crystal cell. Accordingly, as shown in FIG. 6, an effective voltage Veff remaining in the liquid crystal cell in the data-writing period becomes larger than a voltage Vpxl that is applied to the liquid crystal cell.

If the high-level common voltage Vcomh or the low-level common voltage Vcoml is large, as mentioned above, then the effective voltage Veff remaining in the liquid crystal cell can be maintained at a large value. Thus, all the liquid crystal cells maintain a black state in a normally white (NW) mode while maintaining a white state in a normally black (NB) mode.

In the response period of the liquid crystal (LIQUID CRYSTAL RESPONSE PERIOD), a conventional reference voltage is applied as the common voltage Vcom, thereby allowing a real data voltage Vpxl to be applied to the liquid crystal cell. Thus, the liquid crystal is re-aligned in conformity to the data voltage Vpxl that is applied to the liquid crystal cell. Herein, a time required for such a liquid crystal re-alignment is a liquid crystal response time Tf.

In the backlight turning-on period (BACKLIGHT TURNING-ON PERIOD) after such a response time Tf of the liquid crystal cell, the backlight is turned on to display an image upon the LCD screen.

In the liquid crystal re-alignment period (a second LIQUID CRYSTAL RESPONSE PERIOD), a high-level common voltage Vcomh or a low-level common voltage Vcoml is again applied to the liquid crystal cell as the common voltage Vcom. This allows the polarity of the common voltage Vcom that is applied to the liquid crystal cell to be inverted every frame so as to prevent a deterioration caused by a direct current voltage. Accordingly, the liquid crystal is re-aligned in response to an effective voltage larger than the polarity-inverted data voltage to prepare for the next display frame. A time required for such a liquid crystal re-alignment is a response time Tr.

It is desirable that the above-mentioned LCD driving method employs an optically compensated bend (OCB) mode or a ferroelectric liquid crystal mode (FLC) that permits a fast driving of the LCD within one display frame. Alternatively, in a twisted nematic (TN) mode, the high-level common voltage Vcomh and the low-level common voltage Vcoml have a large difference from the conventional common voltage Vcom, thereby allowing a large voltage difference to be generated between an effective voltage Veff that remains within the liquid crystal cell and a voltage Vpxl that is actualy applied to the liquid crystal cell. Accordingly, since the TN mode permits a fast response speed of the liquid crystal cell, the TN mode also is applicable to the LCD driving method according to the present invention.

Figure 7:
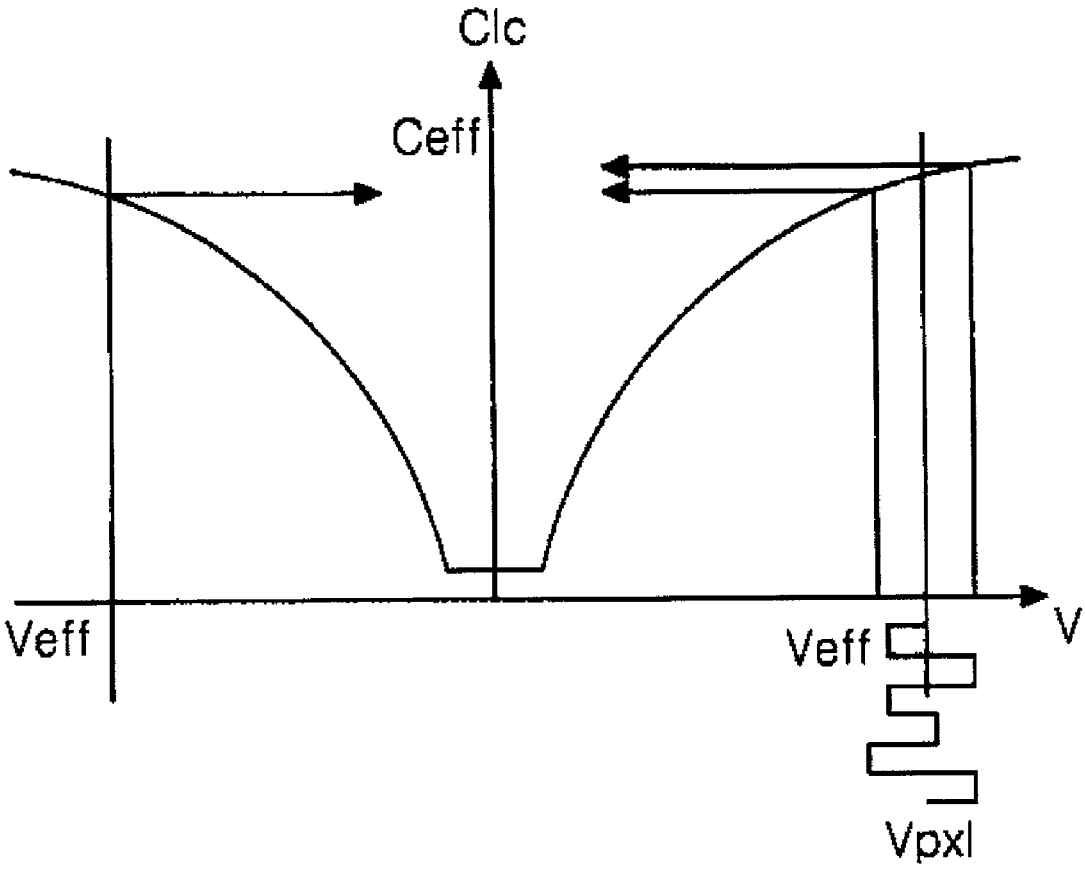
FIG. 7 is a graphical representation showing a relationship between a capacitance of the liquid crystal cell and a voltage applied to the liquid crystal cell in the liquid crystal display driving method according to an embodiment of the present invention.

According to the LCD driving method of the present invention, an application of the high-level common voltage Vcomh or the low-level common voltage Vcoml permits an almost identical liquid crystal alignment when a data voltage is applied to the liquid crystal cell, so that the liquid crystal cell always has substantially the same capacitance value as shown in FIG. 7. More specifically, a high-level common voltage Vcomh or a low-level common voltage Vcoml is applied to the upper substrate when a data voltage is applied to each liquid crystal cell, thereby allowing a capacitance Clc of the liquid crystal cell to have an almost equal value regardless of the data voltage. Thus, a difference voltage ΔVp between the effective voltage Veff remaining in the liquid crystal cell and the voltage Vpxl that is applied to the liquid crystal cell always has substantially the same value. Accordingly, it becomes possible to prevent image quality deterioration caused by a flicker phenomenon in the conventional LCD.

Meanwhile, if an OCB mode is applied to the LCD driving method according to the present invention, then an average applied effective voltage always has a larger value than a voltage when an alignment of the liquid crystal takes a bend state. As a result, it becomes possible to prevent a bend state of the liquid crystal, generated when a common voltage at the upper substrate is changed, from being returned to a splay state, thereby improving brightness of the display image. Also, an alignment film can be made to have a low pre-tilt, so that it becomes easier to form the alignment film.

As described above and in accordance with the present invention, the amount of change in the voltage applied in a general liquid crystal mode is increased, thereby permitting a fast response of the liquid crystal. Accordingly, it becomes possible to improve a contrast efficiency caused by a residual display image. Furthermore, by applying to the common electrode a voltage higher than or lower than a typical common voltage applied in the conventional LCD, the liquid crystal cell is caused to always have substantially the same capacitance value. Accordingly, a voltage difference between an effective voltage remaining in the liquid crystal cell and a voltage actually applied to the liquid crystal cell always has substantially the same value regardless of a voltage applied to the liquid crystal cell, thereby preventing the flicker phenomenon.

It will be apparent to those skilled in the art that various modifications and variations can be made in the method of driving a liquid crystal display of the present invention without departing from the spirit or scope of the invention. Thus, it is intended that the present invention covers the modifications and variations of this invention provided they come within the scope of the appended claims and their equivalents.

What is claimed is:

1. A method of driving a liquid crystal display device during one display frame, comprising the steps of:

applying one of a high-level common voltage and a low-level common voltage to a plurality of liquid crystal cells of the liquid crystal display device to write data into the liquid crystal cells within a time interval shorter than one display frame interval;

applying a reference common voltage to the plurality of liquid crystal cells after applying the one of the high-level common voltage and the low-level common voltage;

turning on a backlight after said data writing to display an image, and re-aligning the liquid crystal cells after the step of turning on the backlight, by applying one of the high-level common voltage and the low-level common voltage or applying a common voltage having a polarity opposite to the common voltage applied when the data is written.

2. The method according to claim 1, wherein after applying one of the high-level common voltage and the low-level common voltage, the liquid crystal cells respond according to the data written between the time when the data is written and when the backlight is turned on.

3. The method according to claim 1, wherein the reference common voltage is lower than the high-level common voltage and greater than the low-level common voltage.

4. The method according to claim 1, wherein when data is being written, an effective voltage remaining in the liquid crystal cell is larger than a data voltage applied to the liquid crystal cell.

5. The method according to claim 1, wherein the high-level common voltage is equal to or more than +15V.

6. The method according to claim 5, wherein the high-level common voltage is equal to a gate high voltage applied to a gate electrode of a thin film transistor of the liquid crystal cell.

7. The method according to claim 1, wherein the low-level common voltage is equal to or less than −5V.

8. The method according to claim 7, wherein the low-level common voltage is equal to a gate low voltage applied to a gate electrode of a thin film transistor in the liquid crystal cell.

9. The method according to claim 1, wherein the driving method is applied to one of an optically compensated bend mode, a ferroelectric liquid crystal mode, and a twisted nematic mode liquid crystal display device.

10. A method of driving a liquid crystal display device during one display frame, the method comprising the steps of:

inputting data signals to a plurality of liquid crystal cells;

allowing the liquid crystal cells to respond to the applied data signals;

applying a reference common voltage to the plurality of the liquid crystal cells after the allowing of the liquid crystal cells to respond, wherein one of a high-level common voltage and a low-level common voltage is applied to the plurality of liquid crystal cells during the inputting step;

turning on a backlight after the step of applying the reference common voltage, and re-aligning the liquid crystal cells after the step of turning on the backlight, by applying one of the high-level common voltage and the low-level common voltage or applying a common voltage having a polarity opposite to the common voltage applied during the step of inputting.

11. The method according to claim 10, wherein the reference common voltage is lower than the high-level common voltage and greater than the low-level common voltage.

12. The method according to claim 10, wherein the high-level common voltage is equal to or more than +15V.

13. The method according to claim 10, wherein the high-level common voltage is equal to a gate high voltage applied to a gate electrode of a thin film transistor of the liquid crystal cell.

14. The method according to claim 10, wherein the low-level common voltage is equal to or less than −5V.

15. The method according to claim 10, wherein the low-level common voltage is equal to a gate low voltage applied to a gate electrode of a thin film transistor in the liquid crystal cell.

16. The method according to claim 10, wherein the driving method is applied to one of an optically compensated bend mode, a ferroelectric liquid crystal mode, and a twisted nematic mode liquid crystal display device.

* * * * *